United States Patent [19]

Schoenmeyr

[11] Patent Number: 4,507,054

[45] Date of Patent: Mar. 26, 1985

[54] LIQUID DISPENSING SYSTEM

[75] Inventor: Ivar L. Schoenmeyr, El Toro, Calif.

[73] Assignee: Carr-Griff, Inc., Anaheim, Calif.

[21] Appl. No.: 392,709

[22] Filed: Jun. 28, 1982

[51] Int. Cl.[3] ..... F04B 49/02; F04B 49/06; F04B 49/08

[52] U.S. Cl. ..... 417/12; 417/44; 417/296; 417/302

[58] Field of Search ..... 417/12, 44, 296, 298, 417/302; 137/512.5

[56] References Cited

U.S. PATENT DOCUMENTS

| | | | |
|---|---|---|---|
| 1,943,102 | 1/1934 | Woodruff | 417/296 |
| 2,049,233 | 7/1936 | Thomas | 417/44 X |
| 2,225,308 | 12/1940 | Kroll | 417/44 X |
| 4,242,061 | 12/1980 | Hartley | 417/536 |

FOREIGN PATENT DOCUMENTS

| | | | |
|---|---|---|---|
| 282776 | 2/1931 | Italy | 137/512.5 |

*Primary Examiner*—Richard E. Gluck
*Attorney, Agent, or Firm*—Gordon L. Peterson

[57] ABSTRACT

A liquid dispensing system comprising a collapsible container, a dispensing head, a conduit leading from the container to the dispensing head and a pump for pumping liquid from the container through the conduit to the dispensing head. A vacuum switch is responsive to a sharp increase in the vacuum on the intake side of the pump to shut the pump off. The pump is controlled by a pressure switch which is responsive to the pressure of the liquid pumped by the pump. A bypass is provided for bypassing liquid in response to a predetermined pressure in the pumping chamber.

10 Claims, 4 Drawing Figures

LIQUID DISPENSING SYSTEM

BACKGROUND OF THE INVENTION

A typical beverage dispensing system includes a container for the beverage or beverage component, a dispensing head, a conduit leading from the container to the dispensing head and a pump for pumping liquid from the container to the dispensing head. The container may contain the beverage, such as wine, which is to be dispensed. Alternatively, the container may contain a beverage component, such as a soft drink syrup, a tea syrup or juice concentrate. In this latter case, a second portion of the system supplies water, which may be carbonated, to the dispensing head which mixes the drink components just prior to dispensing the beverage.

A common form of container for a beverage dispensing system is a collapsible plastic bag contained within a box. In order to pump the bag dry and to have a relatively high output pressure, it is normally preferred to use a fixed displacement pump. Although a centrifugal pump could be used, generally they are not economically feasible for this purpose.

One problem with a fixed displacement pump is that it has a fixed discharge rate for a given speed of operation. Thus, the ideal fixed displacement pump has a pump curve that would provide a constant discharge rate for all operating pressures. In practice, the pump curve has some slope but still does not have a wide range of flow rates. Unfortunately, in a beverage dispensing system, the pump may be called upon to deliver a wide range of flow rates servicing one or more dispensing needs simultaneously and be subjected to numerous variable conditions, such as different viscosity liquids and different lengths and diameters of discharge lines leading from the pump.

Although the stroke length or speed of the pump could be changed, the former reduces the self-priming ability of the pump and the latter is expensive. It is known to alter the shape of a pump curve by bypassing liquid from the discharge side of the pump. However, if this is done, it is not possible to control the pump with a pressure switch which is responsive to the discharge pressure of the liquid being pumped.

SUMMARY OF THE INVENTION

This invention overcomes the disadvantages of the prior art by providing a pumping system which enables a positive displacement pump to have a wide range of flow rates. The pump can also be controlled in response to the pressure of the liquid pumped. This can be accomplished by employing bypass means responsive to the pressure of the liquid in a pumping zone between the inlet and outlet check valves reaching a predetermined level for allowing some of the liquid in such zone to pass out of the zone without being pumped through the outlet check valve.

The typical positive displacement pump has a pumping member, such as a piston, diaphragm or other movable member which moves to pump the liquid through the pump. In addition, a pump of this type commonly employs an inlet check valve, and an outlet check valve. The inlet check valve allows the flow of liquid toward the pumping member and substantially prevents reverse flow through the inlet check valve. Similarly, the outlet check valve allows the flow of liquid therethrough from the pumping member into the discharge line and substantially prevents reverse flow through the outlet check valve. The check valves may be within the pump housing or in the liquid lines leading to and from the pump.

This invention uses the outlet check valve to isolate the bypass means from the pressure sensitive control means which controls the operation of the pump. Thus, the bypass means is responsive to the pressure of the liquid in the pumping zone between the inlet and outlet check valves. The control means, on the other hand, responds to the pressure downstream of the outlet check valve to cycle the pump on and off. In this manner, the bypass can open to allow fluid to escape from the pumping zone at a lower pressure than the control means cycles the pump off.

The bypass means opens to initiate liquid bypass at a first pressure. Opening of the bypass means preferably provides a relatively small controlled area orifice through which liquid from the pumping zone can bleed. After an initial opening phase, the cross-sectional area of the orifice preferably remains essentially constant as the bypass means progressively opens.

Although the bypass means could open to bypass or transmit fluid to a variety of locations, including a reservoir and the atmosphere, preferably the bypass transmits liquid to the upstream side of the inlet check valve. In a preferred construction, there is an inlet chamber immediately upstream of the inlet check valve, and the bypass bypasses liquid from the pumping zone to the inlet chamber. This can advantageously be accomplished by providing a passage which leads from the pumping zone to the inlet chamber or other desired region for liquid discharge and employing a movable valve element for controlling the flow through the passage.

For many applications, it is desired to utilize a pump having a plurality of pumping chambers. Significant economy is obtained with this invention by having at least two of the pumping chambers communicate with the inlet chamber through separate inlet check valves. In this event, the bypass means can bypass liquid from both of the pumping chambers into the inlet chamber. For this purpose, first and second valve elements are provided, and these valve elements can advantageously be aligned and urged away from each other by a single spring which normally maintains both of the valve elements in a closed position. The valve elements are preferably self-aligning and mounted on each other for movement.

The pumping system of this invention includes other advantageous features and components. For example, when the pumping system is used as part of a liquid dispensing system which includes a collapsible container sealed to the atmosphere for containing the liquid to be dispensed, the pumping system preferably includes means responsive to a sharp increase in the vacuum, i.e., decrease in pressure between the pump and the collapsible container for turning the pump off. During normal operation of the pump when the collapsible container has liquid therein, the vacuum in the intake line is only the normal suction pressure for these conditions. However, when the collapsible container runs dry, the vacuum greatly increases, and this is sensed by the vacuum sensing means. As a result, pump operation is discontinued. This result would not be obtainable if the pump were withdrawing liquid from an open storage vessel because the pump would draw in air after the liquid had been exhausted, and this would prevent a sharp increase in the vacuum.

If the pump were permitted to run when there was no liquid to pump, there is a danger that it will burn out. In addition, any soft drink concentrate remaining at the pump would be continually subjected to the moving members, would heat up, boil and leave an undesirable residue which could clog the valves of the system and contaminate the liquid-carrying lines.

It is known to use a vacuum switch on the intake side of the pump to sense the vacuum decrease when the pump runs dry. However, this system would require an override to start the pump and is, therefore, commonly limited to continuously running pumps. By way of contrast, the vacuum shut-off of this invention is particularly adapted for intermittently operated pumps that are supplied with liquid from a collapsible container source.

The invention, together with additional features and advantages thereof, may best be understood by reference to the following description taken in connection with the accompanying illustrative drawing.

DESCRIPTION OF THE PREFERRED EMBODIMENT

Figures 1, 4:
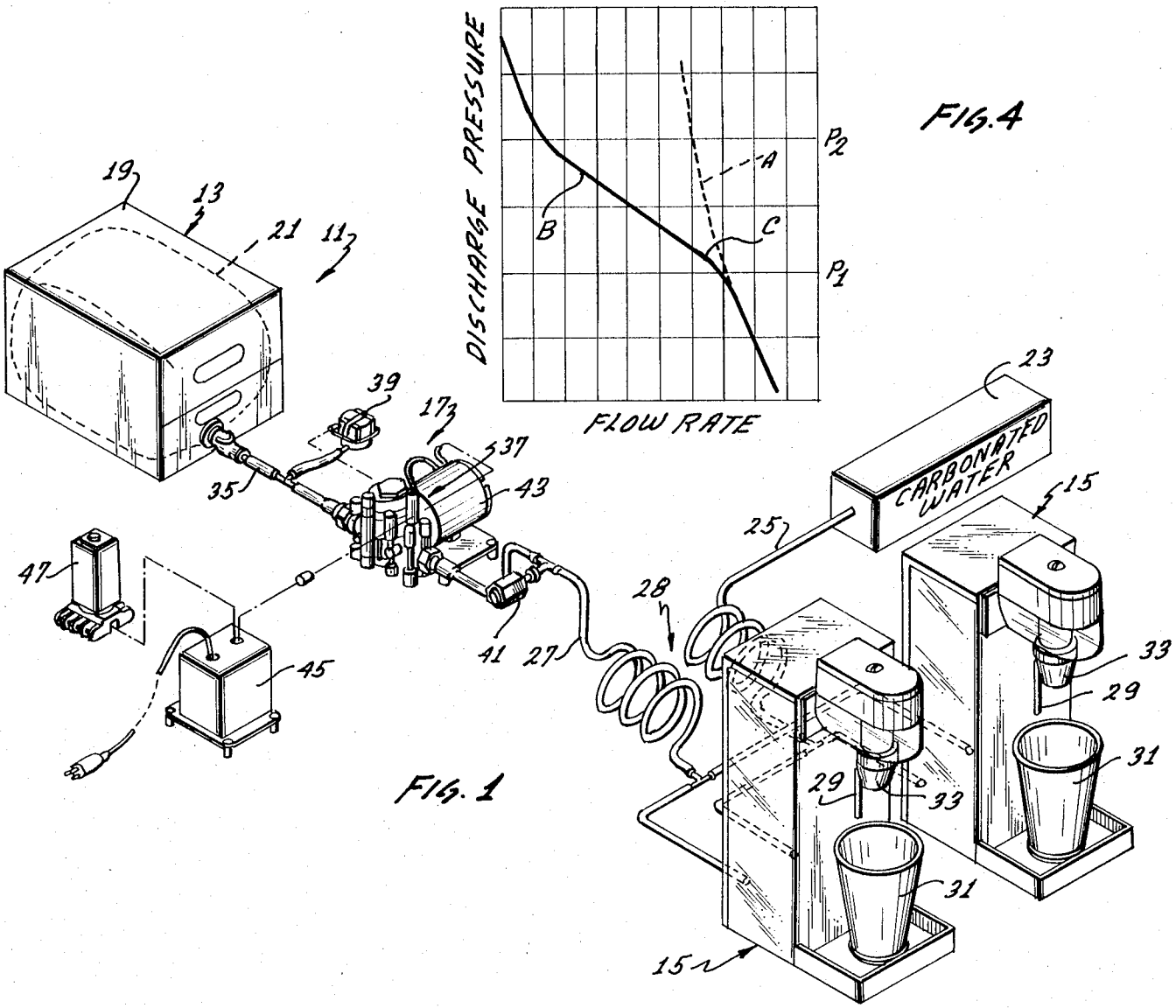
FIG. 1 is a somewhat schematic isometric view of a liquid dispensing system having a pumping system constructed in accordance with the teachings of this invention incorporated therein.
FIG. 4 is a comparative plot of pump discharge pressure versus flow rate for a pump having the bypass feature of this invention. The dashed line in FIG. 4 represents a portion of a pump curve for the pump without bypass.

FIG. 1 shows a liquid dispensing system 11 which generally comprises a source 13 of liquid to be pumped, a plurality of dispensing heads 15 and a pumping system 17 for pumping liquid from the source 13 to the dispensing heads 15. Although the pumping system 17 can be used in a variety of different liquid dispensing systems, in the embodiment illustrated, the dispensing system 11 dispenses a beverage.

The source 13 can be of different constructions but, in this embodiment, comprises a box 19 having a collapsible container 21 therein of plastic or other suitable material for containing a beverage or beverage component in liquid form. This is a conventional liquid source for beverage systems and is commonly known as a bag in a box. By way of example, the collapsible container 21 may contain soft drink syrup, tea syrup, juice concentrate, wine, etc. In the illustrated embodiment, it is assumed that a soft drink concentrate is contained within the collapsible container 21 and that the concentrate is mixed with carbonated water at the dispensing heads 15. The source 23 may be a conventional source of pressurized carbonated water.

The dispensing heads 15 are identical and conventional and one or more of them may be provided. Each of the dispensing heads 15 is provided with carbonated water from a source 23 via a conduit 25, and with soft drink syrup, via a discharge conduit 27 of the pumping system 17. The conduits 25 and 27 may pass through a cooling or refrigerating region 28, if desired.

Each of the dispensing heads 15 includes valves (not shown) for each beverage ingredient which open in response to tilting of a lever 29. This results in mixing the desired ratio of soft drink syrup and carbonated water, and these two ingredients are directed into a cup 31 by a nozzle 33.

The pumping system 17 generally comprises an inlet conduit 35, a pump 37, a vacuum switch 39 coupled to sense the vacuum pressure in the inlet conduit 35, and an air bleed 41 in the discharge conduit 27. The pump 37 is driven by an electric motor 43 which, in the embodiment illustrated, is powered by electrical energy from a twelve-volt transformer 45. If desired, a conventional timer 47 may be electrically coupled to the output of the transformer 45 and the motor 43 to shut down the motor 43, and hence the pump 37, if the pump, during any cycle of operation, runs longer than a predetermined length of time. The timer 47 resets itself automatically each time the motor 43 runs for less than the predetermined length of time. In this way, the pump is positively precluded from running for more than a predetermined interval.

The vacumm switch 39 may be of conventional construction, and it senses the vacuum pressure in the inlet conduit 35. In response to a sharp increase in vacuum, i.e., decrease in pressure, the vacuum switch 39 interrupts the circuit to the motor 43. Such a sharp increase in vacuum occurs when all of the liquid has been pumped out of the sealed collapsible container 21.

The pump 37 is preferably a positive displacement pump and may be constructed in accordance with Hartley U.S. Pat. No. 4,242,061 which is incorporated by reference herein. Briefly, with reference to FIGS. 2 and 3, the pump 37 includes a housing 49 having an inlet 51 adapted for connection to the inlet conduit 35, an outlet 53 shown diagrammatically in FIG. 3 and a pumping member in the form of a piston 55. The piston 55 is sealed to the housing by diaphragms 57 and is reciprocated by any suitable mechanism, such as an eccentric ball bearing drive 59 as shown in the Hartley patent. The piston 55 is double-acting and has two pumping chambers 61 and 63.

The pump 37 has inlet check valve means in the form of identical, coaxial inlet check valves 65 and 67 leading to the pumping chambers 61 and 63, respectively. The inlet check valve 65 includes a conical valve seat 69 having a plurality of openings 71 extending therethrough and a resilient valve element 73. The valve seat 69 is preferably rigid and has a central aperture 75 which receives a sleeve portion 77 of the valve element 73 which extends completely through the aperture and forms an annular valve seat 79 for a purpose described hereinbelow. The sleeve portion has a bypass passage extending through it. The valve element 73 has a resilient conical portion 81 which overlies and sealingly closes the openings 71 in the position shown in FIG. 2. The valve seat 69 is suitably mounted within the housing 49, and in the embodiment illustrated, is mounted in an opening of the diaphragm 57 which seals the valve seat to the housing. Corresponding parts of the inlet check valve 67 are designated by corresponding reference numerals followed by the letter "a."

The housing 49 between the inlet check valves 65 and 67 defines inlet chamber 83. Bypass means 85 is located in the inlet chamber 83. The bypass means 85 includes coaxial valve elements 87 and 89 and a coil compression spring 91 acting between flanges 93 on the valve elements to urge the valve elements axially away from each other. The valve element 87 has a stem 95 which is slidably received within a tubular section 97 of the valve element 89 to mount the valve elements 87 and 89 for relative axial movement. Each of the valve elements 87 and 89 has a section 99 which is coaxial with the associated sleeve portion 77 and 77*a* and projects into the bypass passage of such sleeve portion to define an annular orifice 101. Each of the valve elements 87 and 89 has an axially short conical section 103 for guiding the valve elements into the associated sleeve portions 77 and 77*a*.

Figure 3:
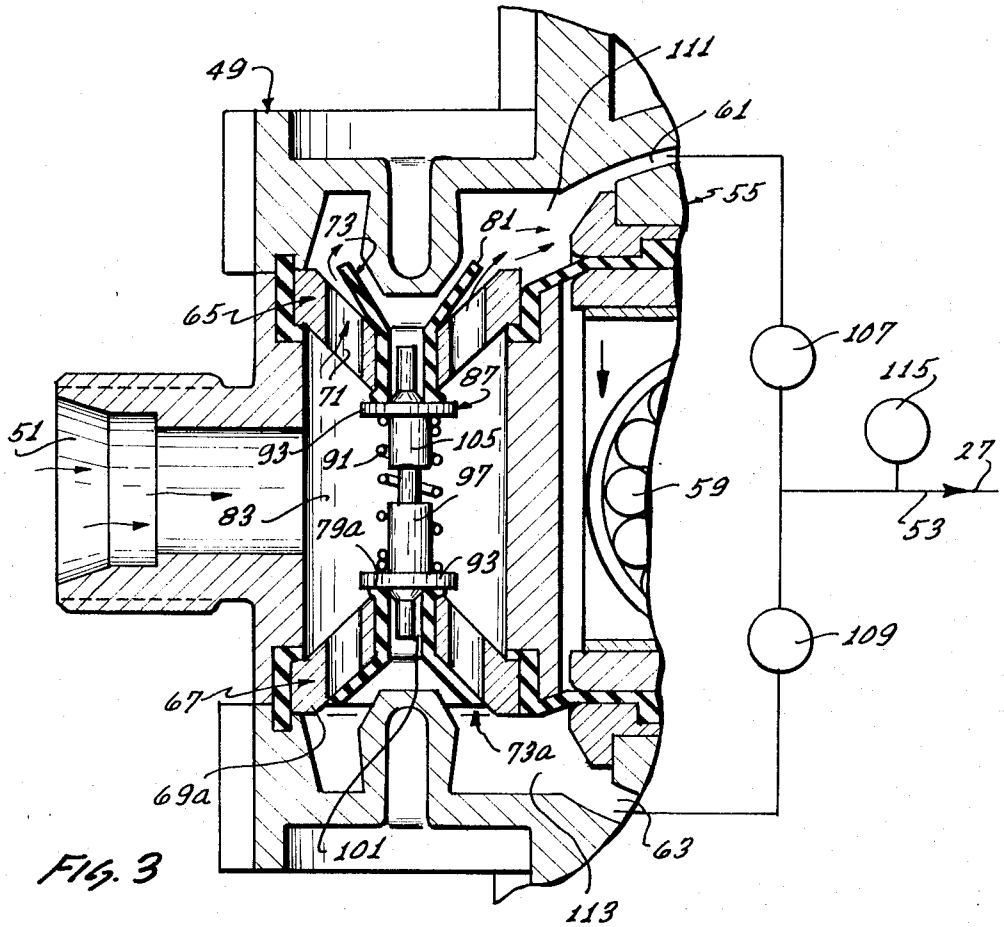
FIG. 3 is a partially schematic sectional view similar to FIG. 2 with one of the inlet check valves open and with the piston of the pump just beginning its downward movement from top dead center.
Figure 2:
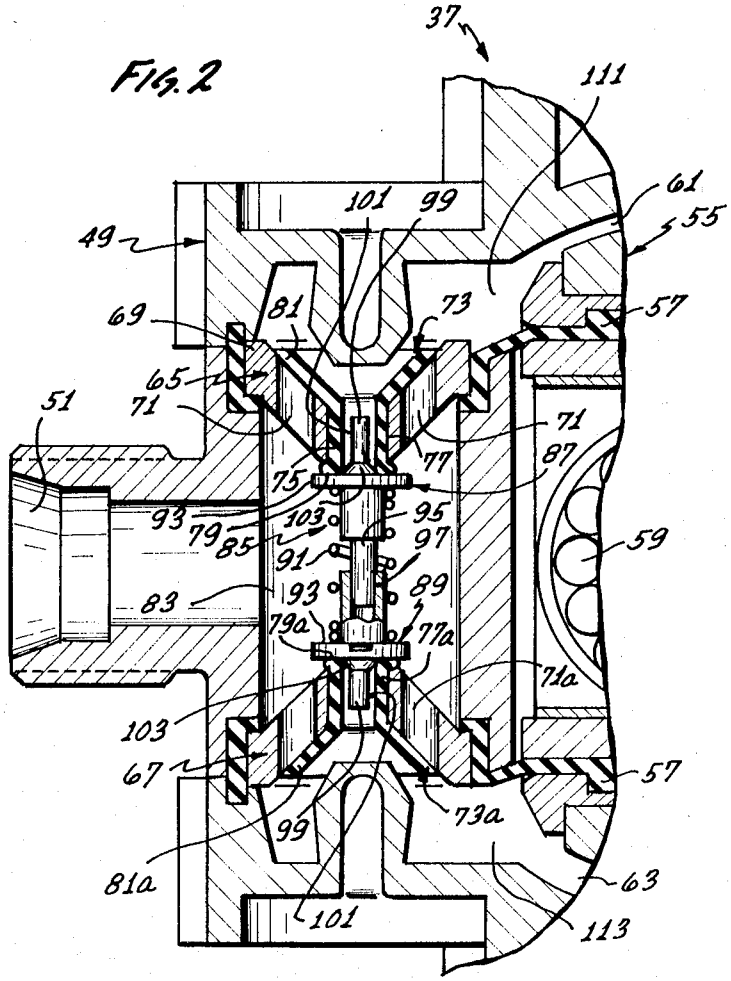
FIG. 2 is an enlarged fragmentary sectional view of a preferred form of bypass means and a portion of the associated pump with the piston of the pump at the top dead center.

In FIGS. 2 and 3, each of the valve elements 87 and 89 is shown in its closed position in which its flange 93 sealingly engages the associated valve seat 79 and 79*a*. The valve elements 87 and 89 are concentric with the inlet check valves 65 and 67 and with each other. The flanges 93 are movable away from their associated valve seats 79 and 79*a* under the influence of fluid pressure in the associated pumping chambers 61 and 63. The single spring 91 biases both of the valve elements 87 and 89 toward their closed position. The valve element 87 has a collar 105 which is engageable with the free end of the tubular section 97 to mechanically limit the maximum opening movement of the valve elements.

The pumping system 17 also has outlet check valve means in the form of identical outlet check valves 107 and 109 for the pumping chambers 61 and 63, respectively, (FIG. 3). The outlet check valves 107 and 109 may be identical to the outlet check valves shown in the above-referred to Hartley U.S. Pat. No. 4,242,061. The outlet check valves 107 and 109 serve the normal check valve function of allowing flow from the respective pumping chambers 61 and 63 toward the dispensing head 15 and preventing flow through the check valve in the reverse direction.

With this construction, the region from the downstream side of the inlet check valve 65 through the pumping chamber 61 to the upstream side of the outlet check valve 107 defines a pumping or pressure zone 111 throughout which the liquid pressure may be assumed to be approximately the same. Similarly, a pumping zone 113 exists between the downstream side of the inlet check valve 67 through the pumping chamber 63 to the upstream side of the outlet check valve 109 throughout which the pressure is approximately the same.

The motor 43 for the pump 37 is cycled on and off in response to the pressure of the liquid in the discharge conduit 27 downstream of the outlet check valves 107 and 109. In the embodiment illustrated, this function is accomplished by a pressure switch 115 (FIG. 3), and if desired, the pressure switch may be mounted and furnished with liquid under pressure as shown in Hartley U.S. Pat. No. 4,242,061. The pressure switch 115 functions in a well-known manner to energize the motor 43 for the pump 37 when the pressure in the discharge conduit 27 drops to a predetermined level and deenergizes the motor 43 for the pump when the pressure of the liquid in the discharge conduit rises to a predetermined level. In the liquid dispensing system illustrated, this means that the pump 37 is cycled on and off in response to the demand for liquid by the dispensing heads 15.

With the pump 37 not running, the inlet check valves 65 and 67, the bypass means 85 and the outlet check valves 107 and 109 are closed. When a demand for liquid from the source 13 is created by one of the dispensing heads 15, the pressure in the discharge conduit 27 drops below the preestablished level, and in response, the pressure switch 115 energizes the motor 43 to initiate operation of the pump 37. As the piston 55 moves downwardly as shown in FIG. 3, suction is created in the pumping chamber 61 which is sufficient to cause liquid to flow through the inlet 51, the inlet chamber 83 and the inlet check valves 65 into the pumping chamber 61. The conical portion 81 of the valve element 73 flexes as shown in FIG. 3 to open the opening 71 to allow liquid to enter the pumping chamber 61.

As the pumping chamber 61 is on the intake stroke, the pumping chamber 63 is on the discharge stroke. This means that, as the piston 55 moves downwardly as shown in FIG. 3, the piston 55 pressurizes the liquid in the pumping chamber 63 sufficiently to force it out through the outlet check valve 109 and into the discharge conduit 27. During this period, the differential pressure across the inlet check valve 67 is sufficient to hold the valve element 71*a* tightly against the valve seat 79*a*.

When the piston 55 moves upwardly, the pumping chambers 61 and 63 are on the discharge and intake strokes, respectively. If the bypass means 85 were not provided, operation of the pump would continue in this manner and would generate a pump curve A as shown by way of example in FIG. 4. However, with the bypass means 85, the bypass means opens at a preselected pressure in the pumping chambers 61 and 63, such as the pressure $P_1$ to provide a pump curve B as shown by way of example in FIG. 4. The portion of the curve shown in FIG. 4 beneath the intersection of the curves A and B is common to both of these pump curves.

Accordingly, as the piston 55 moves downwardly as shown in FIG. 3, the pressure in the pumping chamber 63 increases, and when the pressure $P_1$ is reached, the valve element 73*a* is forced off of its seat 79*a* against the biasing action of the spring 91 whereupon liquid can flow through the orifice 101 from the pumping chamber 63 to the inlet chamber 83. This reduces the discharge pressure in the pumping chamber 63 for a given flow rate as compared to a pump having the operating characteristics of the pump curve A in FIG. 4. The bypass means 85 enables the pump 37 to operate over a wider range of flow rates that is possible with the conventional pump having the pump curve A. In addition, the bypass reduces the pressure peaks inherent in positive displacement pumps and evens out the flow from the pump.

As pressure in the pumping chamber 63 increases, the valve element 73*a* is urged farther off of its seat 79*a* and this increases the effective area of the bypass opening during an initial opening phase of the bypass. This initial opening phase is represented by a "knee" C on the curve B (FIG. 4) just above the intersection with the curve A. However, following the initial opening phase, the effective area of the orifice 101 remains essentially constant, although the total resistance to flow would diminish somewhat as a result of a shorter flow path and wider spacing between the flange 93 and the valve seat 79*a*. By controlling the area of the orifice 101, the slope of the pump curve B can be controlled.

The pressure $P_1$ at which the valve element 73*a* begins to lift off of its valve seat 79*a* can be controlled by the force of the spring 91. Preferably, the normal pump operating range is above the pressure $P_1$ so that the valve element 73a opens on each downward stroke of the piston 55. The exceptions to this would include during priming and high liquid demand by the dispensing heads 15. Similarly, the valve element 73 would also open at the pressure $P_1$ on each upward stroke of the piston 55 and function in the same manner as described hereinabove for the valve element 73a. In this manner, the single spring 91 is used to control the bypass valve elements 73 and 73a for the two pumping chambers 61 and 63.

When the demand for liquid from the source 13 at the dispensing heads 15 terminates, or prior to this time if the demand is rather low, the pressure in the discharge conduit 27 downstream of the outlet check valves 107 and 109 will rise to a predetermined level, such as the pressure $P_2$ shown in FIG. 4. In response to the pressure rising to the level $P_2$, the pressure switch 115 deenergizes the motor 43 thereby stopping the pump 37. It should be noted that the pressure $P_2$ to which the pressure switch responds is less than the pressure $P_1$ to which the bypass means 85 responds. However, because the outlet check valves 107 and 109 provide pressure isolation between the pumping zones 111 and 113, the operation of the bypass means does not prevent the pressure switch 115 from controlling the cycling of the pump on and off.

The timer 47 serves as a safety override to terminate operation of the motor 43 and the pump 37 if, during any cycle of operation, the pump runs for longer than a preestablished interval. The air bleed 41 eliminates air from the discharge conduit 27 in a conventional manner.

Although an exemplary embodiment of the invention has been shown and described, many changes, modifications and substitutions may be made by one having ordinary skill in the art without necessarily departing from the spirit and scope of this invention.

I claim:

1. A pumping system comprising:

a pump for pumping liquid, said pump having an inlet and an outlet and including a movable pumping member for pumping the liquid;

inlet check valve means on the inlet side of the pumping member for allowing the flow of liquid toward the pumping member and substantially preventing reverse flow through the inlet check valve means;

outlet check valve means on the outlet side of the pump for allowing the flow of liquid downstream away from the pumping member and substantially preventing reverse flow through the outlet check valve means;

bypass means responsive to the pressure in a pumping zone between the inlet check valve means and the outlet check valve means reaching a predetermined level for allowing some of the liquid in said pumping zone to pass out of said pumping zone without being pumped by said pumping member through said outlet check valve means;

control means responsive to the pressure of the liquid pumped by the pumping member for at least partially controlling the operation of the pump;

said pump having first and second pumping chambers and said pumping member moving in both of said pumping chambers such that the first chamber is on intake and discharge strokes when the second chamber is on discharge and intake strokes, respectively, said inlet check valve means including first and second inlet check valves for allowing flow of liquid toward the first and second pumping chambers, respectively, and for preventing reverse flow from the pumping chambers through said inlet check valves, said pumping zone including a first portion which includes the first pumping chamber and a second portion which includes the second pumping chamber, said bypass means including first and second passages leading from said first and second portions, respectively, and first and second valve elements and biasing means for urging said first and second valve elements away from each other to close the first and second passages, respectively; and said first valve element includes a tubular section and said second valve element includes a stem slidably receivable in said tubular section to at least assist in mounting said valve elements for movement toward and away from each other.

2. A pumping system as defined in claim 1 wherein said pump includes a housing, said inlet and outlet being on said housing and said inlet check valve means being within said housing, said housing having an inlet chamber between the inlet check valve means and the inlet, and said valve elements are mounted for movement in the inlet chamber.

3. A pumping system as defined in claim 1 one of said valve elements having a first section receivable in the associated one of said passages and projecting only part way through said associated passage when the valve element engages the valve seat, said first section being spaced from the wall of said associated passage to define an orifice whereby limited axial movement of said one valve element in the passage does not substantially change the area of said orifice.

4. A pumping system as defined in claim 1 wherein said valve elements are substantially concentric and each is movable without imparting motion to the other.

5. A pumping system as defined in claim 1 including a vacuum switch responsive to the pressure on the inlet side of said pump dropping to a predetermined subatmospheric level for discontinuing operation of the pump.

6. A pumping system as defined in claim 1 wherein the first inlet check valve includes a movable check valve element which is movable independently of said first valve element whereby movement of the movable check valve element does not impart motion to the first valve element.

7. A pumping system comprising:

a pump for pumping liquid, said pump having an inlet and an outlet and including a movable pumping member for pumping the liquid;

inlet check valve means on the inlet side of the pumping member for allowing the flow of liquid toward the pumping member and substantially preventing reverse flow through the inlet check valve means;

outlet check valve means on the outlet side of the pump for allowing the flow of liquid downstream away from the pumping member and substantially preventing reverse flow through the outlet check valve means, the region between said inlet and outlet check valve means being a pumping zone;

bypass means in continuous communication with the region of the pumping zone between the pumping member and the outlet check valve means and responsive to the pressure in the pumping zone reaching a predetermined level for allowing some of the liquid in said pumping zone to pass out of said pumping zone without being pumped by said pumping member through said outlet check valve means;

control means responsive to the pressure of the liquid pumped by the pumping member for at least partially controlling the operation of the pump;

said pump having first and second pumping chambers and said pumping member moving in both of said pumping chambers such that the first chamber is on intake and discharge strokes when the second chamber is on discharge and intake strokes, respectively, said inlet check valve means including first and second inlet check valves for allowing flow of liquid toward the first and second pumping chambers, respectively, and for preventing reverse flow from the pumping chambers through said inlet check valves, said pumping zone including a first portion which includes the first pumping chamber and a second portion which includes the second pumping chamber, said bypass means including first and second passages leading from said first and second portions, respectively, and first and second valve elements and biasing means for urging said first and second valve elements away from each other to close the first and second passages, respectively; and said first valve element including a tubular section and said second valve element including a stem slidably receivable in said tubular section to at least assist in mounting said valve elements for movement toward and away from each other.

8. A pumping system as defined in claim 7 wherein said biasing means includes a single spring for urging said first and second valve elements away from each other.

9. A pumping system as defined in claim 7 including timing means responsive to the pump running for more than a predetermined interval during any one cycle of operation for stopping the pump.

10. A pumping system as defined in claim 7 wherein said control means is responsive to the pressure of the liquid downstream of the outlet check valve means.

* * * * *